US006222499B1

(12) United States Patent
Goetz et al.

(10) Patent No.: US 6,222,499 B1
(45) Date of Patent: Apr. 24, 2001

(54) SOLDERLESS, COMPLIANT MULTIFUNCTION RF FEED FOR CLAS ANTENNA SYSTEMS

(75) Inventors: Allan C. Goetz, La Jolla; Jeffrey A. Douglass, Poway, both of CA (US)

(73) Assignee: TRW Inc., Redondo Beach, CA (US)

( * ) Notice: Subject to any disclaimer, the term of this patent is extended or adjusted under 35 U.S.C. 154(b) by 0 days.

(21) Appl. No.: 09/469,654

(22) Filed: Dec. 22, 1999

(51) Int. Cl.[7] ..... H01Q 1/50

(52) U.S. Cl. ..... 343/860; 343/705; 343/708; 343/906

(58) Field of Search ..... 343/860, 861, 343/862, 864, 705, 708, 906

(56) References Cited

U.S. PATENT DOCUMENTS

| | | | | |
|---|---|---|---|---|
| 5,618,205 | | 4/1997 | Riddle et al. . | |
| 5,825,332 | | 10/1998 | Camacho et al. . | |
| 6,039,580 | * | 3/2000 | Sciarretta et al. | 439/63 |
| 6,094,171 | * | 7/2000 | Riddle et al. | 343/708 |
| 6,097,343 | * | 8/2000 | Goetz et al. | 343/708 |

* cited by examiner

*Primary Examiner*—Tan Ho
*Assistant Examiner*—Ephrem Alemu
(74) *Attorney, Agent, or Firm*—Michael S. Yatsko

(57) ABSTRACT

A compliant RF feed system (10) that provides impedance matching for VHF/AM, VHF/FM, UHF and L-band frequencies. The feed system (70) includes a feed post (14) electrically connected to an antenna element (18) at one end and a matching circuit package (22) at an opposite end, where the feed post (14) extends across a non-conductive gap (16) between the antenna element (18) and a conductive aircraft component (20). The matching package (22) includes a compressible bellows (38) mounted in the package (22), where the feed post (14) contacts the bellows (38) in a compression engagement to provide an electrical connection between the feed post (14) and a RF matching circuit (24) in the matching package (22). An impedance transformer (40) is provided in the matching package (22) to match the impedance of the bellows (38) to the matching circuit (24). The bellows (38) allows the electrical connection between the antenna element (18) and the aircraft component (20) to accommodate vibrations during aircraft operation. In order to accommodate L-band frequencies, a feedthrough (74) is provided between an L-band antenna element (72) and an L-band matching network (76) in the package (22). The feedthrough (74) extends through the feed post (14) and the bellows (38), and is electrically isolated therefrom.

20 Claims, 3 Drawing Sheets

SOLDERLESS, COMPLIANT MULTIFUNCTION RF FEED FOR CLAS ANTENNA SYSTEMS

BACKGROUND OF THE INVENTION

1. Field of the Invention

This invention relates generally to a feed system for an antenna, and, more particularly, to a feed system used in connection with a low observable, multifunction, conformal, load bearing structure antenna on an aircraft that provides an RF feed for VHF/FM, VHF/AM, UHF and L-band frequencies.

2. Discussion of the Related Art

Modern manned and unmanned tactical military aircraft require radio communications over several frequency bandwidths and communication modes to support the communications, navigation and identification (CNI) functions necessary for operation of the aircraft. These radio frequency (RF) bandwidths generally include the VHF frequency modulation (FM) band (30–88 MHz), the VHF amplitude modulation (AM) band (118–174 MHz), UHF band (225–400 MHz), and L BAND (962–1213 MHz). The required L-band functions are JTIDS, MIDS, and TACAN.

To transmit and receive signals in these frequency bands, a suitable antenna system is required that is configured on the aircraft. Generally, multiple blade antennas are required for the CNI functions, including one for the VHF/FM frequency band, one for the VHF/AM frequency band and another one for the UHF frequency band. the available antenna installation sites on an aircraft may not support the number of antennas needed by the required CNI functions if each function requires its own antenna. Because modern tactical aircraft are usually low-observable aircraft, it is necessary that the antenna elements conform to the aircraft structure to minimize the radar cross-section (RCS) of the aircraft and that require a feed that connects separate conductive structures.

To overcome the requirements of multiple antennas to support the CNI functions, and to eliminate the need for blade antennas, U.S. Pat. No. 5,825,332 issued Oct. 20, 1998, titled "Multifunction Structurally Integrated VHF-UHF Aircraft Antenna System," assigned to the assignee of this application and herein incorporated by reference, discloses an aircraft antenna that is totally integrated within the aircraft, and operates over a wide range of frequencies, including the VHF/FM, VHF/AM and UHF frequency bands. To operate in this manner, the antenna system uses an electrically conductive element that is part of the aircraft structure and an antenna element positioned and shaped to form a notch therebetween. The notch is generally uniform in width over part of its length and flares to a larger width over the remainder of its length. Broadband impedance matching electronics are provided to couple the antenna system to a transceiver to provide efficient transfer of energy to and from the antenna.

Other antenna systems have also been proposed that conforn with the existing aircraft structure. For example, U.S. patent application Ser. No. 09/178,356, filed Oct. 23, 1998, titled "A Conformal Load-Bearing Antenna System," assigned to the assignee of this application, and herein incorporated by reference, discloses a conformal load bearing antenna structure (CLAS) that is configured within the skin of the aircraft so that the antenna element does not increase the RCS of the aircraft. The CLAS manufacturing processes allow the antenna elements to be integrated within a composite RF window that carries a load that would be carried by the replaced skin panel. The CLAS antenna elements also use part of the aircraft skin as the radiating element.

Antenna elements manufactured with the CLAS manufacturing process require a suitable RF feed that connects the antenna element to the matching electronics. U.S. patent application Ser. No. 09/233,361, titled "A Dual-Feed System for a Multifunction, Conformal, Load-Bearing Structure Excitation Antenna," filed Jan. 19, 1999, assigned to the assignee of this application, and herein incorporated by reference, discloses a dual-feed system for providing a feed structure within the notch between the antenna element and the conductive aircraft structure of the type discussed in the '332 patent. The feed structure includes two feed posts strategically positioned along the notch so that the feed posts provide impedance matching at the desirable frequencies. In one particular design, an aft feed post provides impedance matching at a feed point location for the UHF and VHF/FM bands, and a forward feed post provides impedance matching at a feed point location for VHF/AM frequencies. The feed posts can be made of any suitable conductive material, such as brass, gold, nickel, etc., and can have any suitable shape, such as cylindrical and conical shapes. The feed posts are connected to the antenna element and the aircraft structure by a solder connection.

The aircraft structure is subject to high vibration and temperatures during operation. Therefore, the feed connection must be able to withstand this environment. The CLAS antenna elements are actual load bearing parts of the aircraft, such as a vertical tail end cap or fin cap. Feed structures with a soldered or rigid mechanical connection would quickly fail. Additionally, it is necessary to provide a feed connection that provides impedance matching for all of the VHF/AM, VHF/FM, UHF and L-band frequencies.

What is needed is a compliant RF feed connection that satisfies the above requirements. It is therefore an object of the present invention to provide such an RF feed.

SUMMARY OF THE INVENTION

In accordance with the teachings of the present invention, a compliant RF feed system is disclosed that provides impedance matching for VHF/AM, VHF/FM, UHF and L-band frequencies. The feed system includes a feed post electrically connected to an antenna element at one end and a matching circuit package at an opposite end, where the feed post extends across a non-conductive gap between the antenna element and a conductive aircraft component. The matching circuit package includes a compressible bellows mounted in the package, where the feed post contacts the bellows in a compression engagement to provide an electrical connection between the feed post and a RF matching circuit in the matching package. An impedance transformer is provided in the matching package to match the impedance of the bellows to the matching circuit. The bellows allows the electrical connection between the antenna element and the aircraft component to accommodate the vibrations during aircraft operation.

In order to accommodate L-band frequencies, a feedthrough is provided from an L-band antenna element to an L-band matching network in the package. The feedthrough extends through the feed post and the bellows, and is electrically isolated therefrom.

Additional objects, advantages and features of the present invention will become apparent from the following description and appended claims, taken in conjunction with the accompanying drawings.

DETAILED DESCRIPTION OF THE PREFERRED EMBODIMENTS

The following discussion of the preferred embodiments directed to a compliant RF feed for a CLAS in an aircraft is merely exemplary in nature, and is no way intended to limit the invention or its applications or uses.

Figure 1:
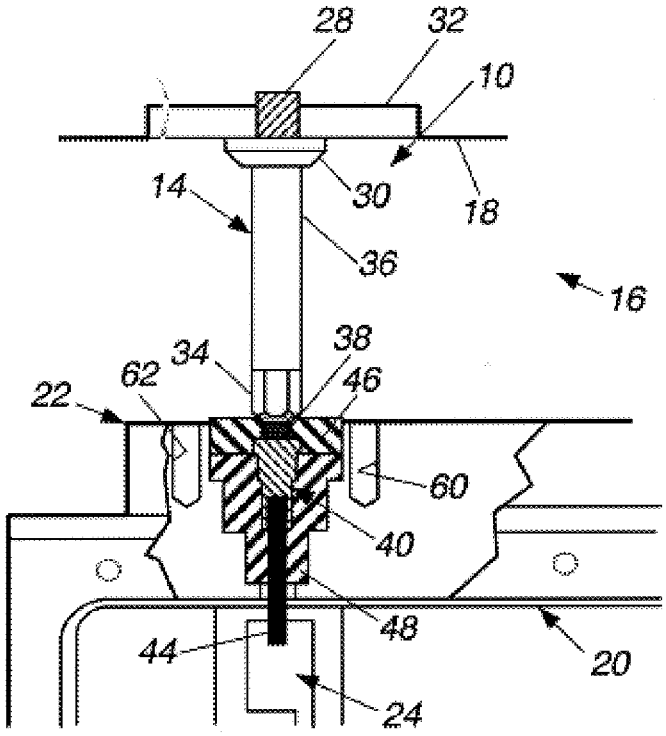
FIG. 1 is a cross-sectional view of a three function compliant feed for a CLAS antenna system, according to an embodiment of the present invention.
Figure 2:
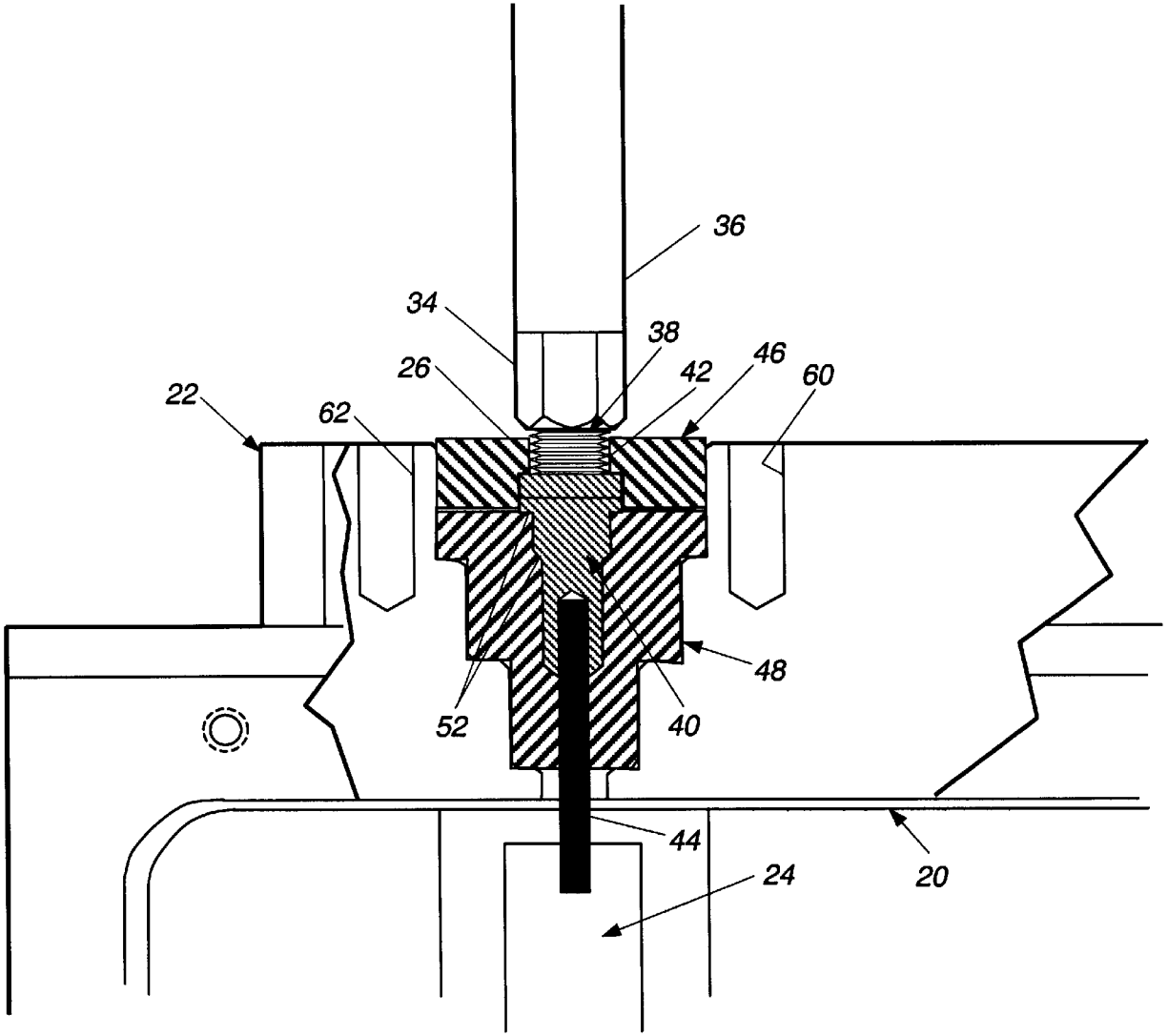
FIG. 2 is an enlarged partial view of the antenna system shown in FIG. 1.

FIG. 1 is a cross-sectional view of a compliant antenna feed system 10 for use in connection with an antenna system of the type discussed in the '332 patent referred to above, that is made by the CLAS manufacturing process. FIG. 2 is an enlarged partial view of the antenna system shown in FIG. 1. The antenna feed system 10 includes a feed post 14 positioned across a notch 16 between an antenna excitation element 18 and a conductive aircraft structural component 20. The feed post 14 is able to replace one of the feed posts in the feed structure discussed in the '361 patent application referred to above. The notch 16 provides electrical insulation between the antenna element 18 and the structural component 20, and can be any suitable non-conductive material, such as air or a phenolic honeycomb, as would be understood by those skilled in the art. The feed post 14 is positioned at a suitable location along the length of the notch 16 to provide impedance matching for the desirable frequency band, such as the UHF, VHF/AM or VHF/FM band. The complete feed system in this embodiment would include another feed post for the other UHF or VHF band.

The feed structure 10 directs the signals received by the antenna element 18 to matching electronics 24 within a matching circuit package 22. Additionally, the feed post 14 directs signals to be transmitted by the antenna element 18 received from the matching electronics 24. The matching electronics 24 converts the feed point impedance to the transceiver output impedance, usually 50 ohms, and the transceiver output impedance to the feed point impedance. The aircraft structural component 20 can be a tail, fin, wing, stabilizer, or other aircraft structure of the aircraft. Both the antenna element 18 and the aircraft component 20 are excited as a result of currents flowing in these structures from transmitted signals from the transceiver (not shown) or electromagnetic signals received from the air. These currents create electromagnetic fields across the notch 16. The notch 16 radiates generally omnidirectionally, and both the antenna element 18 and the component 20 radiate as a result of the currents flowing in these structures.

The feed post 14 includes a threaded protrusion 28 extending from a head 30 of the post 14. The feed post 14 also includes a cylindrical portion 36 extending across the notch 16 to an opposite end 34 of the feed post 14. The shape of the end 34 allows the threaded protrusion 28 of the feed post 14 to be readily threaded into an embedded feed plate 32 within the antenna element 18 by a wrench. The feed plate 32 allows the antenna element 18 to first be manufactured by a CLAS process, so that the feed post 14 can be attached to the element 18 thereafter to provide ease of manufacture. The feed post 14 is made of any suitable conductive material, as would be well understood by those skilled in the art.

Figure 3:
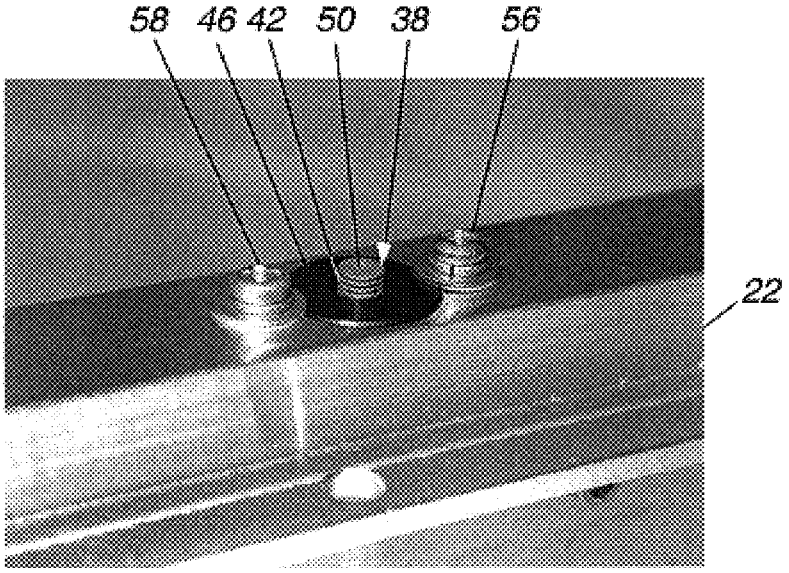
FIG. 3 is a perspective view of a bellows mounted within a matching circuit package for the compliant feed shown in FIG. 2.

In accordance with the teachings of the present invention, a conductive bellows 38 is press fit into an opening 26 in a non-conductive bellows interface element 46 mounted in the matching package 22. FIG. 3 is a perspective view of the bellows 38 in connection with the matching package 22 separated from the feed system 10. The bellows 38 includes a plurality of ridges 42 and a central cylindrical opening 50. The bellows 38 makes electrical contact with a conductive impedance transformer 40 in the matching package 22. The impedance transformer 40 includes steps 52, as shown, to provide impedance matching between the bellows 38 and a conductive trace 44 connected to the matching electronics 24. The transformer 40 is positioned in a nonconductive transformer interface element 48 to electrically isolate the impedance transformer 40 from the conductive portion of the aircraft. The elements 46 and 48 can be made of any suitable non-conductive material, such as Teflon. Bolts 56 and 58 are threaded into holes 60 and 62, respectively, to hold the interface elements 46 and 48 and the impedance transformer 40 within the package 22.

When the feed structure 10 is assembled, the end 34 of the feed post 14 is pressed against the bellows 38, causing it to compress, and make an electrical contact thereto. FIG. 3 shows the bellows 38 in an uncompressed format prior to the combination of the feed post 14 and the antenna element 18 being assembled thereto. The feed post 14 and the bellows 38 complete the electrical contact between the antenna element 18 and the matching network 24 in a non-soldered engagement.

While in flight, the aircraft will undergo vibrations and the like which will go through the aircraft component 20 and into the post 14. The configuration of the bellows 38 and the connection of the feed post 14 to the bellows 38 allows the feed post 14 and bellows 38 to move relative to each other, so that they do not fail as a result of the vibrations.

Figure 4:
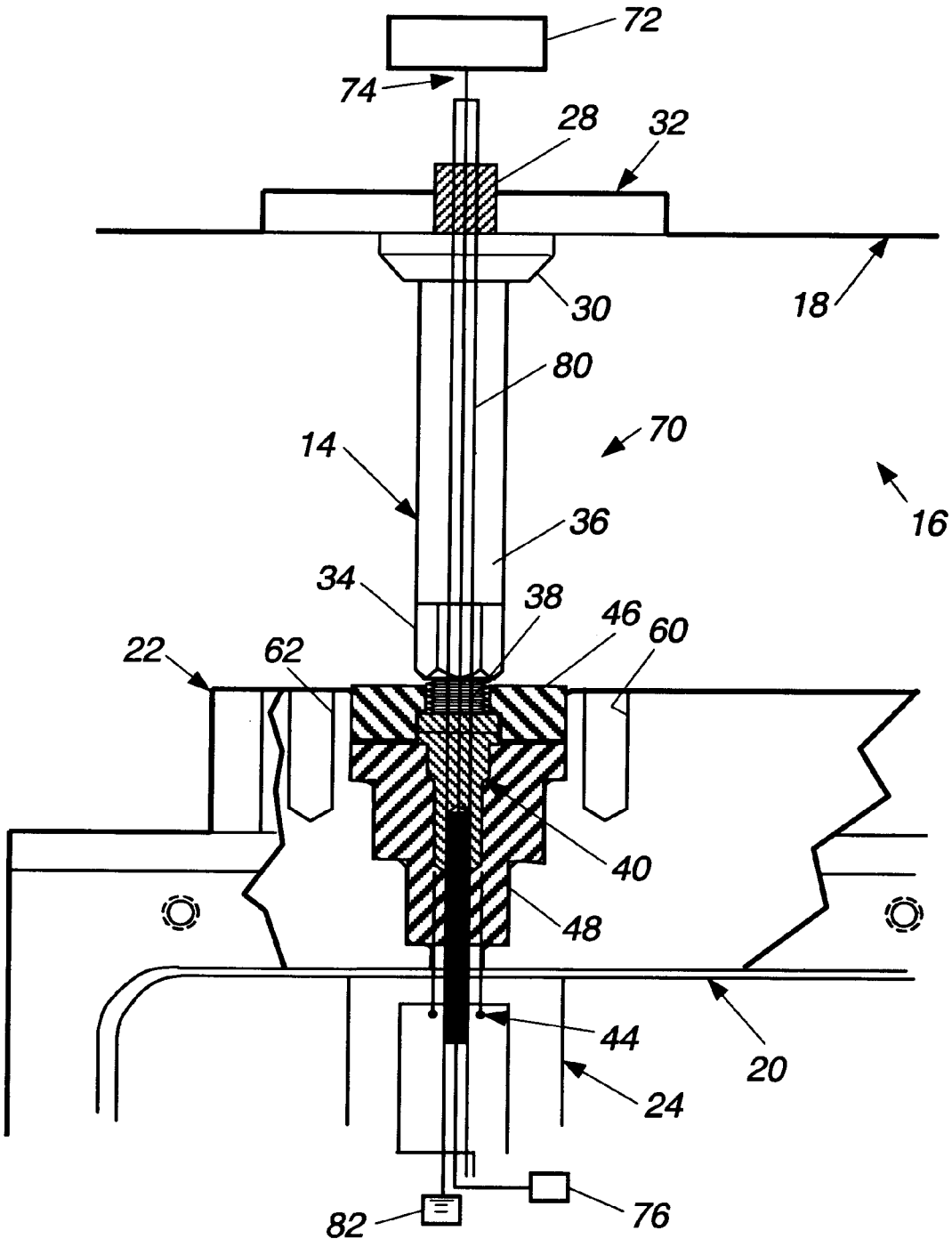
FIG. 4 is a cross-sectional view of a four function compliant feed for a CLAS antenna system, according to another embodiment of the present invention.

The feed system 10 discussed so far provides a feed for the frequency bands in the UHF, VHF/AM or VHF/FM bandwidths. The feed system 10 can also be used in connection with a feed in the L-band frequency range. FIG. 4 is a cross-sectional view of a feed structure 70 that satisfies this purpose. The antenna feed system 70 is similar to the antenna feed system 10, and therefore like components will be identified with the same reference numeral. The feed system 70 provides a feed for an L-band antenna element 72. The antenna element 72 can be configured in any suitable location within the aircraft structure relative to the element 18, as would be well understood to those skilled in the art. A coaxial feedthrough 74 is connected to the feed element 72 and extends through suitable aligned openings in the protrusion 28, the post 14, the bellows 38, the impedance transformer 40, and the spacer element 48. The feedthrough 74 is then electrically connected to an L-band impedance matching circuit 76. In the embodiments discussed herein, the bellows 38 includes the opening 50 for accommodating the coaxial cable associated with the L-band feedthrough 74. In an alternate embodiment, the bellows 38 can be a solid member that provides the necessary resistance and compression for electrically connecting to the feed post 14 in a desirable manner. The coaxial feedthrough 74 is electrically isolated from these conductive components by an insulator layer 80. A ground connection 82 is provided for the outer conductor of the feedthrough 74. Therefore, the feed system 70 can be used for both UHF and L-band connections, or VHF and L-band feed connections.

The foregoing discussion discloses and describes merely exemplary embodiments of the present invention. One skilled in the art will readily recognize from such discussion, and from the accompanying drawings and claims, that various changes, modifications and variations can be made therein without departing from the spirit and scope of the invention as defined in the following claims:

What is claimed is:

1. An antenna feed system for an antenna on an aircraft, said antenna including an antenna element and a conductive aircraft component defining a nonconductive gap therebetween, said system comprising:

a conductive antenna feed post electrically connected to the antenna element and extending across the gap; and a circuit package mounted to the aircraft component and including an impedance matching circuit, said circuit package further including a compressible bellows, said post being in a compression engagement with the bellows to provide an electrical connection between the antenna element and the matching circuit across the gap.

2. The system according to claim 1 wherein the circuit package further includes an impedance transformer, said impedance transformer being electrically connected to the bellows and to the matching circuit for providing impedance matching therebetween.

3. The system according to claim 2 wherein the impedance transformer has a stepped configuration where the transformer gets smaller in a stepped manner from the bellows to the matching circuit.

4. The system according to claim 1 wherein the bellows is mounted within a non-conductive interface member within the circuit package in a compression fit.

5. The system according to claim 1 wherein the feed post includes a threaded protrusion extending from an end of the post opposite the bellows, said protrusion being threadably engaged to the antenna element.

6. The system according to claim 5 further comprising a conductive feed plate positioned in the antenna element, said threaded protrusion being threadably engaged within the feed plate.

7. The system according to claim 1 further comprising an electrical feedthrough extending through the feed post and the bellows.

8. The system according to claim 1 wherein the feed post is a cylindrical member.

9. The system according to claim 1 wherein the bellows includes a plurality of ridges in a stacked configuration to make it compressible.

10. An antenna feed system for an antenna on an aircraft, said antenna including a first antenna element responsive to low frequency RF signals and a second antenna element responsive to high frequency RF signals, said antenna further including a conductive aircraft component where a non-conductive gap is defined between the low frequency antenna element and the conductive aircraft component, said system comprising:

a conductive antenna feed post electrically connected to the first antenna element and extending across the gap, said post including an opening therethrough;

a circuit package mounted to the aircraft component and including a first impedance matching circuit and a second impedance matching circuit, said circuit package further including a compressible bellows having a plurality of stacked ridges and an opening extending therethrough, said feed post being in a compression engagement with the bellows to provide an electrical connection between the first antenna element and the first matching circuit across the gap; and a high frequency antenna feedthrough electrically connected to the second antenna element at one end and the second matching circuit at an opposite end, said feedthrough extending through the opening in the feed post and the opening in the bellows.

11. The system according to claim 10 wherein the circuit package further include an impedance transformer, said impedance transformer being electrically connected to the bellows and to the first matching circuit for providing impedance matching between the bellows and the matching circuit.

12. The system according to claim 11 wherein the impedance transformer has a stepped configuration where the transformer gets smaller in a stepped manner from the bellows to the matching circuit.

13. The system according to claim 10 wherein the feed post includes a threaded protrusion extending from an end of the post opposite the bellows, said protrusion being threadably engaged to the antenna element.

14. The system according to claim 13 further comprising a conductive feed plate positioned in the first antenna element, said threaded protrusion being threadably engaged to the feed plate.

15. The system according to claim 10 wherein the feed post provides a feed for one of either the VHF/FM and UHF frequency band or the VHF/AM frequency band and the second antenna element and antenna feedthrough provide a feed for the L-band frequency range.

16. A method of providing a feed connection between an antenna element on an aircraft and an RF matching circuit, said method comprising the steps of:

connecting a feed post to the antenna element;

mounting the matching circuit in a circuit package mounted to an aircraft component;

positioning a compressible bellows in the matching package in electrical connection with the matching circuit; and positioning the feed post against the compressible bellows so that the bellows compresses and provides an electrical connection between the antenna element and the RF matching circuit.

17. The method according to claim 16 further comprising the step of positioning an impedance transformer in the matching circuit that is in electrical contact between the bellows and the RF matching circuit.

18. The method according to claim 17 wherein the step of positioning the impedance transformer includes positioning an impedance transformer with a step down configuration from the bellows to the matching circuit.

19. The method according to claim 16 wherein the step of connecting the feed post to the antenna element includes threading the feed post into a feed plate within the antenna element.

20. The method according to claim 16 further comprising the steps of extending a feedthrough through the feed post and the bellows and independently connecting the feedthrough to an L-band antenna element and an L-band matching circuit.

* * * * *